US010821502B2

(12) United States Patent
Breuer et al.

(10) Patent No.: US 10,821,502 B2
(45) Date of Patent: Nov. 3, 2020

(54) METHOD AND CASTING/ROLLING SYSTEM FOR CASTING AND ROLLING A CONTINUOUS STRAND MATERIAL

(71) Applicant: SMS group GmbH, Düsseldorf (DE)

(72) Inventors: Michael Breuer, Hilchenbach (DE); Axel Weyer, Wuppertal (DE)

(73) Assignee: SMS group GmbH, Düsseldorf (DE)

( * ) Notice: Subject to any disclaimer, the term of this patent is extended or adjusted under 35 U.S.C. 154(b) by 117 days.

(21) Appl. No.: 15/514,249

(22) PCT Filed: Aug. 4, 2015

(86) PCT No.: PCT/EP2015/067910
§ 371 (c)(1),
(2) Date: Mar. 24, 2017

(87) PCT Pub. No.: WO2016/045847
PCT Pub. Date: Mar. 31, 2016

(65) Prior Publication Data

US 2017/0266704 A1 Sep. 21, 2017

(30) Foreign Application Priority Data

Sep. 24, 2014 (EP) ..... 14186114

(51) Int. Cl.
*B21B 1/46* (2006.01)
*B22D 11/06* (2006.01)
(Continued)

(52) U.S. Cl.
CPC ..... *B22D 11/20* (2013.01); *B21B 1/463* (2013.01); *B21B 11/00* (2013.01); *B21B 37/26* (2013.01);
(Continued)

(58) Field of Classification Search
CPC . B22D 11/06; B22D 11/0617; B22D 11/0622; B22D 11/1226; B22D 11/143;
(Continued)

(56) References Cited

U.S. PATENT DOCUMENTS

2008/0035300 A1* 2/2008 Beyer-Steinhauer ..... B21B 37/52 164/459
2010/0038048 A1* 2/2010 Schmidt ..... B22D 11/1206 164/4.1

FOREIGN PATENT DOCUMENTS

CN 103602886 A 2/2014
DE 2833756 A1 2/1979
(Continued)

OTHER PUBLICATIONS

Decision for Patent Grant dated Sep. 2, 2018 in corresponding Korean Application No. 10-2017-7009253; 3 pages including English-language translation.
(Continued)

*Primary Examiner* — Christopher J Besler
(74) *Attorney, Agent, or Firm* — Maier & Maier, PLLC

(57) ABSTRACT

A method for operating a casting/rolling system and to a corresponding system for casting and rolling an endless strand material. The casting/rolling system comprises a strand casting machine and a rolling train arranged downstream of the strand casting machine. The method has the following step: controlling the drive for the rollers of the first roller frame of the rolling train by means of a drive control in response to a target value specification of the pass sequence model. Furthermore, the drive of the at least one strand guiding roller is controlled by a strand guiding roller drive control in response to a target value specification of the strand casting machine drive model.

13 Claims, 5 Drawing Sheets

(51) Int. Cl.

| | |
|---|---|
| ***B22D 11/14*** | (2006.01) |
| ***B21B 11/00*** | (2006.01) |
| ***B22D 11/16*** | (2006.01) |
| ***B21B 37/26*** | (2006.01) |
| ***B22D 11/20*** | (2006.01) |
| ***B22D 11/12*** | (2006.01) |
| *B21B 37/00* | (2006.01) |
| *B22D 11/128* | (2006.01) |
| *B21B 37/46* | (2006.01) |
| *B22D 11/124* | (2006.01) |

(52) U.S. Cl.
CPC ..... *B22D 11/0622* (2013.01); *B22D 11/1226* (2013.01); *B22D 11/143* (2013.01); *B22D 11/16* (2013.01); *B21B 37/46* (2013.01); *B21B 2037/002* (2013.01); *B21B 2275/12* (2013.01); *B22D 11/124* (2013.01); *B22D 11/1206* (2013.01); *B22D 11/128* (2013.01); *B22D 11/1282* (2013.01)

(58) Field of Classification Search
CPC ..... B22D 11/16; B21B 1/04; B21B 1/463; B21B 11/00; B21B 2037/002; B21B 37/26; B21B 2275/12
See application file for complete search history.

(56) References Cited

FOREIGN PATENT DOCUMENTS

| | | | |
|---|---|---|---|
| DE | 102004010038 | A1 | 9/2005 |
| EP | 1720669 BI | | 11/2006 |
| EP | 2346625 BI | | 7/2011 |
| JP | S55014133 | A | 1/1980 |
| JP | S55014134 | A | 1/1980 |
| JP | S56114522 | A | 9/1981 |
| JP | S60221103 | A | 11/1985 |
| JP | S60227958 | A | 11/1985 |
| JP | 2007185703 | A | 7/2007 |
| WO | 2010/049280 | A2 | 5/2010 |

OTHER PUBLICATIONS

Chinese Office Action dated Apr. 23, 2018, in connection with corresponding CN Application No. 2015800601862 (2 pgs., English translation only).
Chinese Search Report dated Apr. 12, 2018, in connection with corresponding CN Application No. 2015800601862 (2 pgs.).
International Search Report dated Nov. 4, 2015 in corresponding Application No. PCT/EP2015/067910; 10 pgs.
International Preliminary Report on Patentability dated Sep. 20, 2016 in corresponding Application No. PCT/EP2015/067910; 17 pgs.

* cited by examiner

100

METHOD AND CASTING/ROLLING SYSTEM FOR CASTING AND ROLLING A CONTINUOUS STRAND MATERIAL

The device relates to a method as well as a casting/rolling system for casting and rolling an endless strand material consisting of metal, in particular steel.

Figure 1:
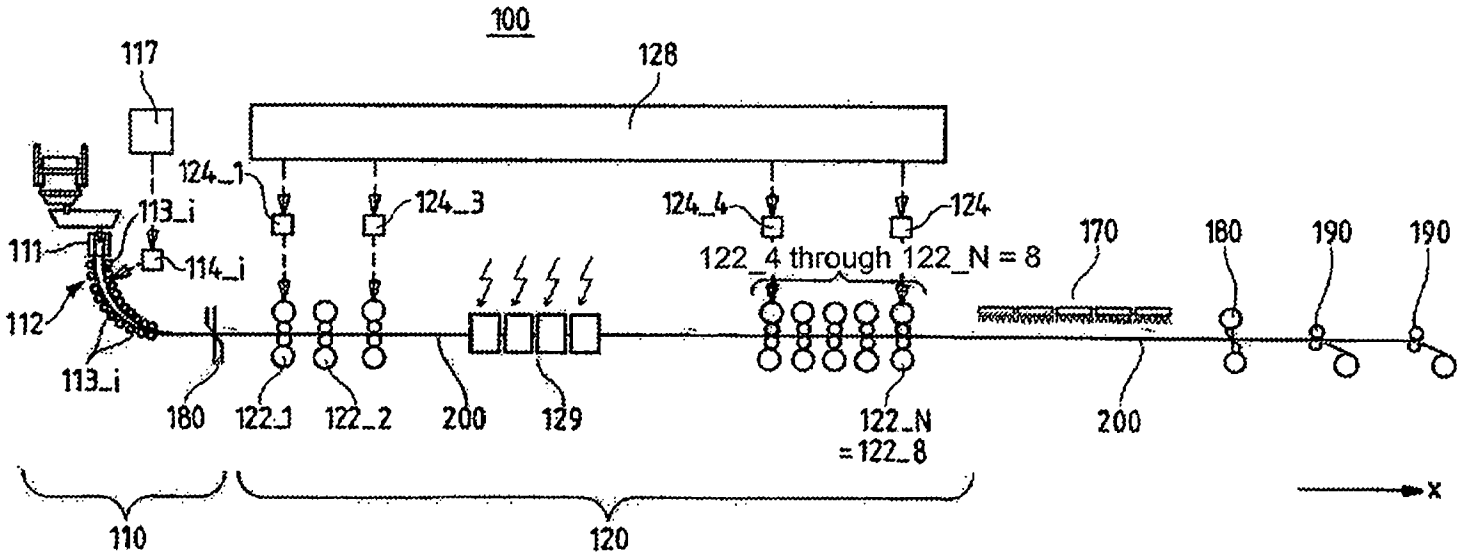
Fig. 1 Prior Art

A known casting and rolling system for casting and rolling an endless strand material is shown by way of an example in FIG. 1. The casting/rolling system 100 shown here comprises a strand casting machine 110, a rolling line 120 connected downstream of the strand casting machine, a cooling section 170 connected downstream of the rolling line, a separating device 180 connected downstream of the cooling section, and a winding device 190 for winding the strand material 200. Specifically, the strand casting machine 110 comprises a chill-mold 111, a strand guide 112 arranged downstream of the rolling line, and typically also a separating device 180. The separating device 180 is used for separating a so-called cold strip. The melt solidifies in the mold on the primary cooled walls of the chill-mold 111 in the chill-mold and the strand shell of a strand material is formed in this manner. The strand material formed in this manner, which is still fluid inside, is after exiting the chill-mold 111 supported in the strand guide 112 by means of strand guide rollers 113 and it is deflected from the vertical direction into the horizontal direction. For this purpose, strand guide rollers **113_*i* are actively driven at least partially by means of drives 114_*i*. The drives 114_*i* are controlled by a strand guide roller drive controller 117. The rolling line 120 typically comprises n=1 through N roller frames 122_*n*, each of which is typically associated with drives 124_*n* for driving the rollers. The first roller frames n=1 through L with L=3 roller frames 122_1 through 3 form a group of roughing frames, each of which is associated with the drives 124_1 through 3. Heating is connected downstream of the roughing frames, preferably as an inductive heating 129, in order to heat the roughed strand material 200 to a desired finishing rolling temperature, before it is subsequently rolled (finished into a group of) roller frames 122_4 through N and the rolling is finished there to a desired final thickness. The individual roller frames 122_*n* are typically associated with individual drives 122_*n*, which are individually controlled by a superordinate drive controller 128. The path coordinates, which have the same meaning as the casting direction or the direction of the flow of the material, are designated in FIG. 1** with the reference symbol x.

Figure 2:
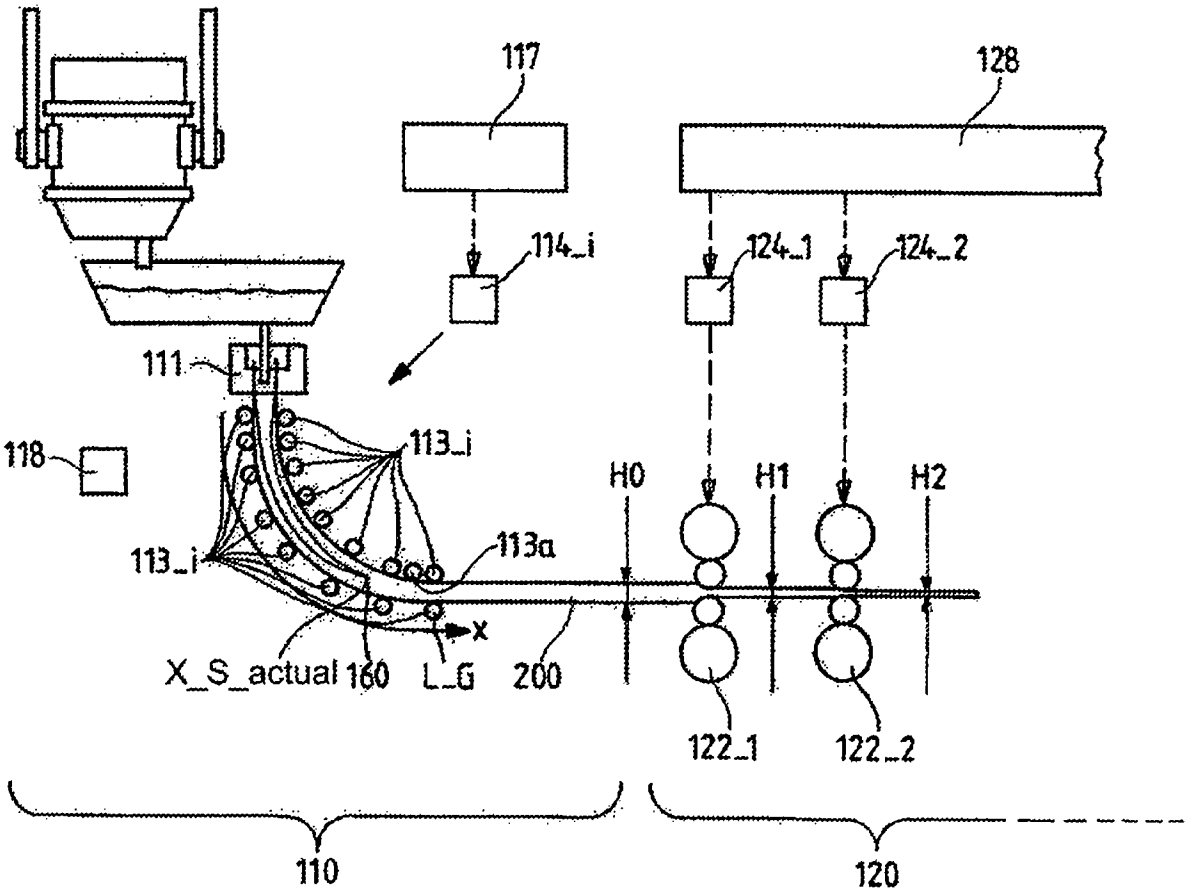
Fig. 2 Prior Art

FIG. 2 shows a detailed view of a casting/rolling system 100 known from prior art that was just described with reference to FIG. 1. To the extent that the same technical elements are shown in FIG. 2, they are designated with the same reference symbols. In this respect, the same description as that of FIG. 1 is applicable also to FIG. 2. In addition, it should be merely mentioned that unlike the strand guiding rollers **113_*i*, the strand guiding rollers designated with the reference symbol 113*a* are not driven. Moreover, with respect to the strand guide 112, the bottom tip 160 and its actual position along the path coordinate x are designated with the reference symbols X_S_Ist. Finally, it can be seen here that the thicknesses of the strand material 200 at the exit from the strand casting machine 110 is designated with the reference symbol H0, at the exit of the first roller frame with the reference symbol H1, and at the exit of the second roller frame with the reference symbol H2**.

The essential characteristic during the manufacturing of a continuous strand material 200, or during continuous rolling operations, is that the strand material 200 is cooled in the chill-mold 111 with solidification in the strand guide 112 and it is not separated until the rolling or thickness reduction occurs in the rolling line 120. The above-mentioned separation of the cold strand at the exit of the strand guide 112 is at the same time not contradictory, because the cold strand is not yet the actual continuous strand material. A separation of the continuous material takes place only by means of the separating device 180 shown in FIG. 1, just before the coiling device 190, in order to cut the previously continuously rolled strand material 200 to the desired coil length.

Due to the law of the constant mass flow, the mass flow is essentially constant in a coupled casting/rolling process, such as in the process occurring during continuous rolling, in every position at the casting/rolling system 100. However, disturbances of the constant process can occur for example when the strand material 200 is accumulated (when loops are formed), or when it is stretched (the strand material can also become torn in extreme cases). The causes for such discontinuities in mass flow are for example occurrences such as when material is not supplied continuously or when the mass flow is delayed, or when the coiling device does not ensure sufficient removal of the mass flow or of the strand material.

There are also other important items that need to be taken into consideration—on their own—such as the consideration as to whether the mass flow can be maintained constantly, or whether it can be regulated; see for example European Patent Publication EP 1 720 669 B1. Regulation of mass flow within a (finishing) rolling line is described in the German Patent Application DE 283 37 56 A1.

Another possibility for regulating the mass flow, in particular in a (finishing) rolling line, is when a storage unit is built for the material rolled in the mass flow and the mass flow is regulated with suitable variations of the stored volume of the strand material. Such storage devices can be realized for example in the form of looping storage devices. However, with material thicknesses of the strand material above 20 mm, no loops are formed due to the high stiffness depending on the material. Especially in the area just behind the casting machine, this option is for this reason not used with materials that have said large thicknesses.

A looping control is known for example from the Japanese Patent Application JP 2007185703 A. However, the technical teachings of both prior art documents relate only, as was mentioned, to individual components of the system, but not to an overall solution for both components of the system, namely the strand casting machine and the rolling line. Instructions for an overall solution, or for a synchronization between a strand casting machine and a rolling like are disclosed in the European Patent Publication EP 2 346 625 B1. Specifically, the patent publication proposes to use the outlet speed of the rolled material from a unit arranged in advance, for example for the casting machine, during a modification of the thickness of the strand material in the rolling line. However, said patent application does not say anything about the specific implementation of this technical teaching. Moreover, upon a closer consideration of this solution, it is apparent that the disadvantage here is that the main drives of the rolling line, which have the output capacity of several megawatts, have to follow the drives of the continuous casting machine with only a few kW of the drives of the strand casting machine, so that the output speed of the strand material from the strand casting machine is lost. This is a disadvantage in terms of control technology, because the regulation dynamics, which is to say the dynamics of a drive, are decreased with an increased size of the motor. It is therefore always advantageous when a small motor is allowed to follow a larger one rather than vice versa.

Japanese Application JP 56114522 discloses a casting/rolling system in which the freshly cast metal strip first passes through a pair of driving rollers and then it passes at least through a roller frame. Both the drive rollers and the processing rollers of the first roller frame are respectively rotationally driven. The torque of the driver rollers is kept constant by means of a control device. Specifically, this makes is possible to achieve that the rotational speed of the processing rollers of the roller frame can serve as a setting variable and it is thus suitably varied in order to keep the torque of the processing rollers constant.

Japanese patent applications JP 55014133 A, JP 55014134 and JP 60221103 A are therefore further referred to only for technological background. The object of the invention is to further develop a known method and a known casting/rolling system for casting and rolling strand material such that the drive of both the strand cast machine and of the rolling line will be synchronized in a superordinate manner with regard to a constant and uniform mass flow in both parts of the system.

This object is achieved with respect to the method by the method claimed in patent claim 1. This method is characterized in that a pass sequence model specifies in advance a set rotational speed as a target value speed for the drive of the first rolling line of the first rolling line, and in that the strand casting machine drive models uses as a target value for a target torque for the drive of the at least driven strand guide roller.

With this claimed solution, the typically very powerful drive of the of the first roller frame is provided in advance with a target rotational speed, while in particular all the drives of the upstream driven strand guide rollers are not provided with preset a rotational speed, but instead with a torque that is set in advance. The advantageous effect is that first roller frame stipulates the speed and thus the mass flow not only in the rolling line, but also in the strand casting machine upstream. In this respect, the first roller frame functions as a "speed master" or as a "mass flow master". The mass flow is thus determined by the thickness of the strand material at the inlet and outlet of the first roller frame, as well as by the rotational speed of the processing rollers of the first roller frame. The rotational speed is determined and preset by means of a pass sequence model as will be described later. An overfeed for the range of the speed of the rollers of the first roller frame is in this case also calculated and taken into account as appropriate. Since only one target torque is provided in advance for the drives of the strand guide rollers in the strand casting machines, instead of a target rotational speed, the advantage is that the detection of the rotational speeds can be omitted both for the strand guide rollers and for the rollers of the roller frames. The claimed rotational speed specification only for the first roller frame with a simultaneous torque specification for the strand guide rollers makes it possible to set in an advantageous manner automatically the constant for the mass flow in both parts of the system, which is to say both in the strand casing machine and in the rolling line. In other words, the drives or the rotational speeds of the strand guide rolls in the strand guide follow the mass flow as predetermined by the first roller frame, or the speed predetermined by the first roller frame. Compensation is provided for small errors in the calculation of the mass flow carried out in the pass sequence model. Another advantage of the claimed solution is that detection of the rotational speed can be omitted both for the strand guide roller and for the rollers of the roller frame. The claimed rotational speed specification for only the first roller frame with a simultaneous torque specification for the strand guide rollers enables to set in an advantageous manner the desired constant automatically in both parts of the system, namely both in the strand machine and in the rolling line.

When according to a first embodiment, the rolling line has more than one roller frame, typically n=2 through N roller frames, it is provided according to the invention that the pass sequence model assigns in each case an individual desired torque also for the drives of the rollers of the roller frame following the first roller frame as n=2 through N. This ensures that the first roller frame alone will remain the "speed master" or "mass flow master" because due to the set torque specification, the rotational speeds or the rotational speed of the rollers for the following roller frames can be freely set as n=2 through N. The claimed specification of the set rotational speed for only one single drive in the strand casting system and in the rolling line ensures that there will be no disturbances of the constant character of the mass flow, for example due to inaccurate synchronization of the drives with the assigned rotational speed. Thanks to the claimed solution, wherein only one single drive is provided with an assigned torque in advance, while other drives follow it both in the strand casting machine and in the rolling line, advantages are obtained according to the invention for the rotational speeds of all other drives automatically in such a way that mass flow is determined from the first roller frame as required according to the law of constant mass flow, without requiring controlled synchronization for this purpose.

The specification described above of the individual torques set for the following roller frames of n=2 through N in the rolling line can be realized for any thicknesses of the strand material. As an alternative, there is the option that when the thickness of the strand materials at the outlets of the k roller frame with $2 \leq k < N$ falls below a predetermined thickness threshold value, an individual torque is provided only for the respective drives of the roller frames n=2 through k. The remaining roller frames n=k+1 through N will with this alternative not be assigned any predetermined torque to be set for the drives of the roller frame, but instead, the mass flow is kept constant below the k-roller frame—seen in the direction of the mass flow—which is then controlled to remain constant by means of the controlled looping formation of the strand material. However, this alternative embodiment of the invention is only possible under the mentioned condition, namely that the material of the strand product has a sufficient elasticity or a sufficient flexibility for loop formation; this elasticity or flexibility is decisively represented by said thickness threshold element of the strand material.

In order to control the loop formation, it is advantageous when the respective actual positions of the loops of the strand material are monitored for a predetermined target position, which is to say a predetermined target volume in the loop storage device.

When deviations occur, rotational speeds of the adjacent frames are corrected accordingly, so that the correction is selectively applied to the previous or to the subsequent arranged frame.

The thickness threshold value is for example 40-20 mm. It is dependent on the material characteristics of the strand material, for example on the modulus of elasticity of the strand material.

It is further advantageous when the slippage of at least one of the strand guide rollers is monitored and controlled as required, so that the risk of twisting of the strand guide monitored for slippage is recognized.

It is also advantageous when the position of the bottom tip inside the strange guide is controlled with suitable variations of the control variables to keep it in a predetermined target position or desired position. For this purpose, a solidification process is simulated with a corresponding control circuit which simulates the control path, which is to say the solidification process in the stand casting machine, by means of a solidification model. The correcting variables are calculated by a controller and output to the solidification model. The correcting variables, which can influence the position of the bottom tip, include in particular the intensity of the cooling of the strand material in the casting machine, the format of the cross-section, in particular the thickness of the strand material in certain internal locations and at the exit of the strand guide, and the casting speed, as well as the geometry of the casting machine.

The geometry of the casting machine reflects its mechanical construction, which includes for example the length, the position of the roller, the shape of the chill-mold, the arrangement of the cooling, etc.

In the steady state of the casting/rolling system, said correcting variables fluctuate, if they do at all, only very little. According to the invention, said two correcting variables, specifically the thickness of the strand material at the exit of the strand casting machine and the casting speed, each time in the steady state, serve as input variables for the pass sequence model. The pass sequence model then calculates from these input variables, as well as preferably in addition also based on the determination of the measured thicknesses at the exit of the first and second roller frame of the rolling line, the target rotational speed for the drive of the first roller frame n=1, as well as the target torques for the drives of the following roller frames n=2 through N, before this value is output to the drive control device for driving the roller frames.

In addition, according to the invention, the target torque set for the drive of at least one driven strand guide roller is determined in accordance with the determination of the value for the thickness of the strand material at the exit of the strand guide and of the value determined for the casting speed, each time in the steady state of the casting/rolling system, as well as according to the determination of the value for the total strand torque and (the profiles) of the strand shell thickness and of the temperature of the strand material and calculated and preset at the exit of the strand guide from the strand casting machine/drive model.

It is advantageous when the target torques for the drives of the strand guide rollers are specified so that they are suitable distributed over the length of the strand guide by the strand casting machine/drive model, in particular by taking into account the geometry of the strand casting machine, the total strand extraction torque, and while taking into account also (the distribution) of the thickness of the strand shell and the temperature of the strand material over the length of the strand guide.

The total strand extraction torque can be determined from the total of the individual strand roller torques during casting, or by means of the solidification model.

It is also advantageous when the target torques are predetermined by the strand casting/machine drive model in such a way that they are rising significantly in a first region of the chill-mold outlet until the bottom tip of the strand material at the actual position of the strand material within the strand guide, and remain significantly constant in a second region from the position of the bottom tip until the until the metallurgical length of the strand casting machine. Finally, it is advantageous when the modification of the value for the target rotational speed and/or the target values for the torques does not take place in an abrupt manner, but if it is developed as an increasing or decreasing tendency over time, for example in the form of a ramp. This guarantees that the dynamic load on the drives does not become too large.

Further, the method also permits adjustment of the roller thicknesses H0 to HN during a current operation, so that the adjustment of the casting thickness occurs dynamically by means of a flexible adjustment of the strand guide rollers with a simultaneous adjustment of the target torque. These values are determined by a combination of the solidification model with the strand casting machine drive model. The control commands, such as for example for adjusting the thickness of the rollers, are forwarded to the corresponding supported roller positions and their drives according to the correctly specified time and position. With the pass sequence model, which determines the control variables again with appropriately modified boundary conditions, the rolling line receives newly determined control variables with the correct time and location determination for the new target values for the rotational speed, the torques and the roller thicknesses H1 through HN. Changes of the thicknesses for the finishing belt can be thus made without having to restart the system again.

The technical task of the invention identified above is further solved with the casting/rolling system claimed. The advantages of this solution basically correspond to the advantages regarding the method claimed above. It is essential that the entire casting/rolling system, which is to say in particular the pass sequence model and the strand casting machine(s)/drive model(s) unit is/are designed in order to carry out the method according to the invention.

The casting/rolling system preferably comprises a bottom tip control circuit for controlling the position of the bottom tip of the strand material in the strand guide, a slippage detection unit and/or a mass flow regulating circuit for regulating the mass flow of the strand material between two, preferably adjacent, roller frames of the rolling line when the strand material therein is suitably elastic or flexible for loop formation, for example when its thickness between the roller frames is below a predetermined thickness threshold value.

The rolling line can be provided with n=1 through L roughing frames and with n=L+1 finishing roller frames. In this case, the first roller frame of the rolling line, at which the target rotational speed is predetermined in accordance with the invention, is a roughing frame.

Advantageous embodiments of the method according to the invention and of the casting/rolling system are the subject of the dependent claims.

Figure 3:
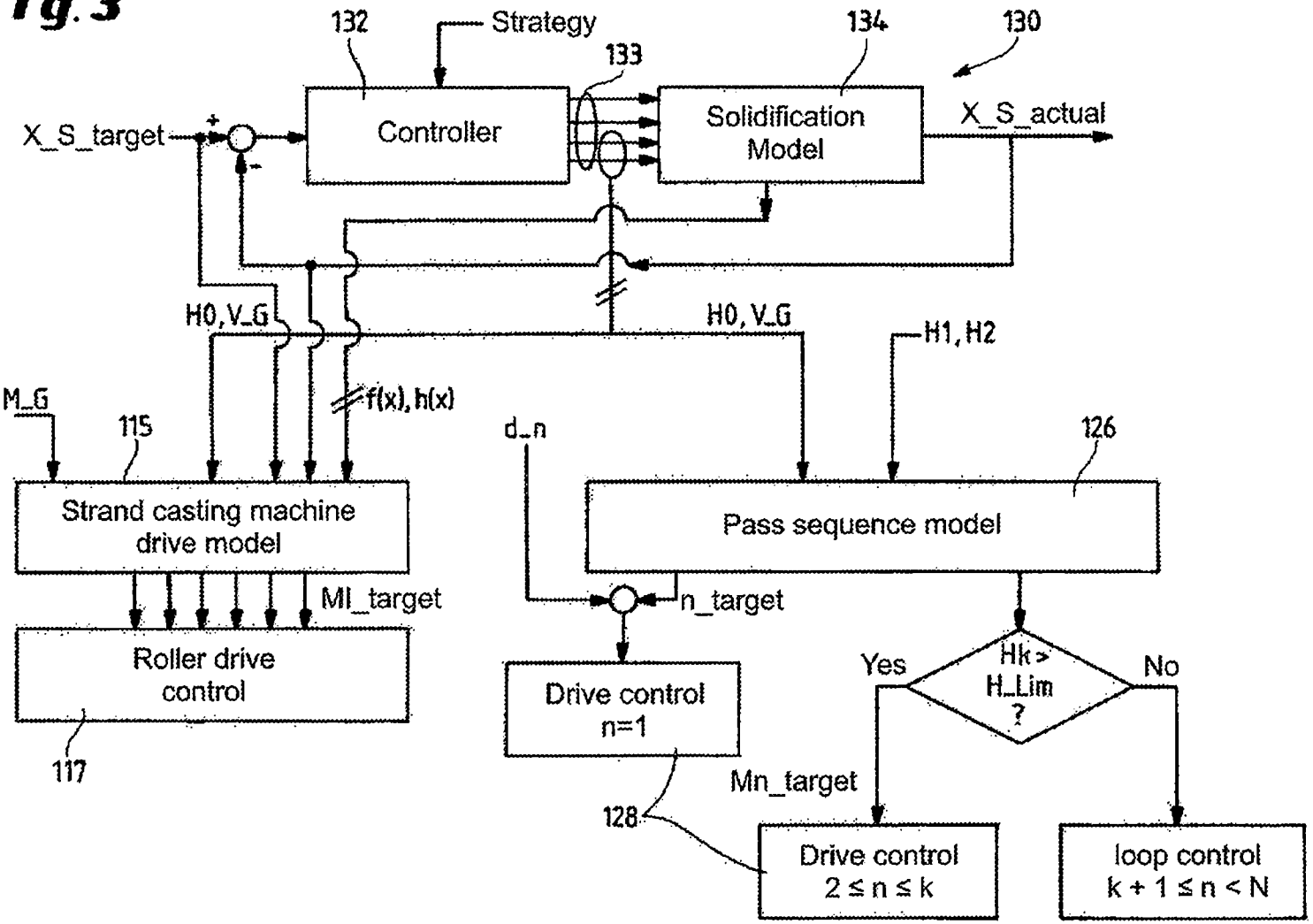
Figure 4:
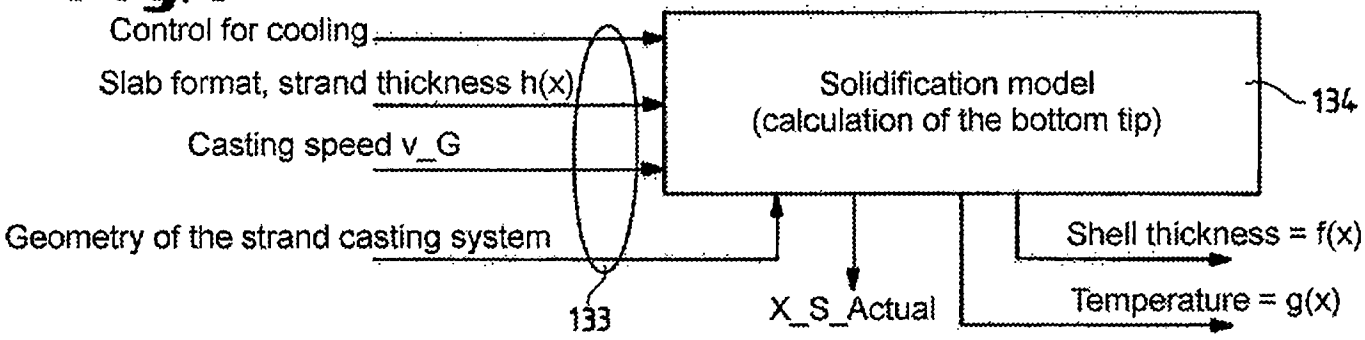
Figure 5:
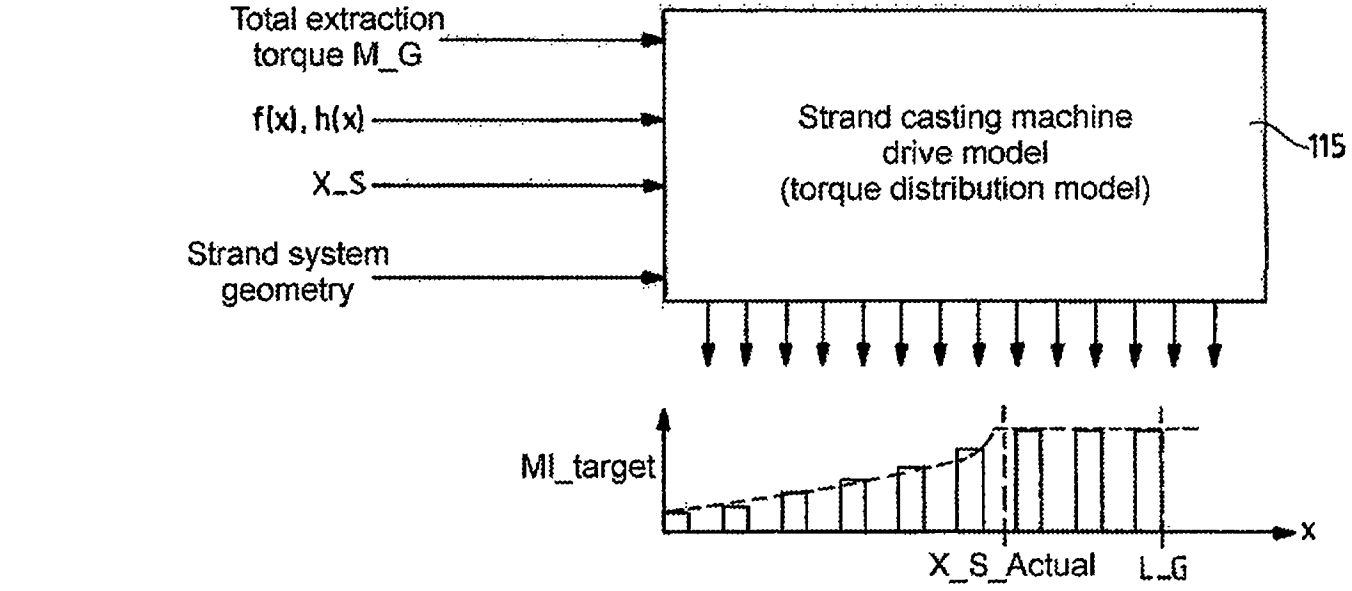
Figure 6:
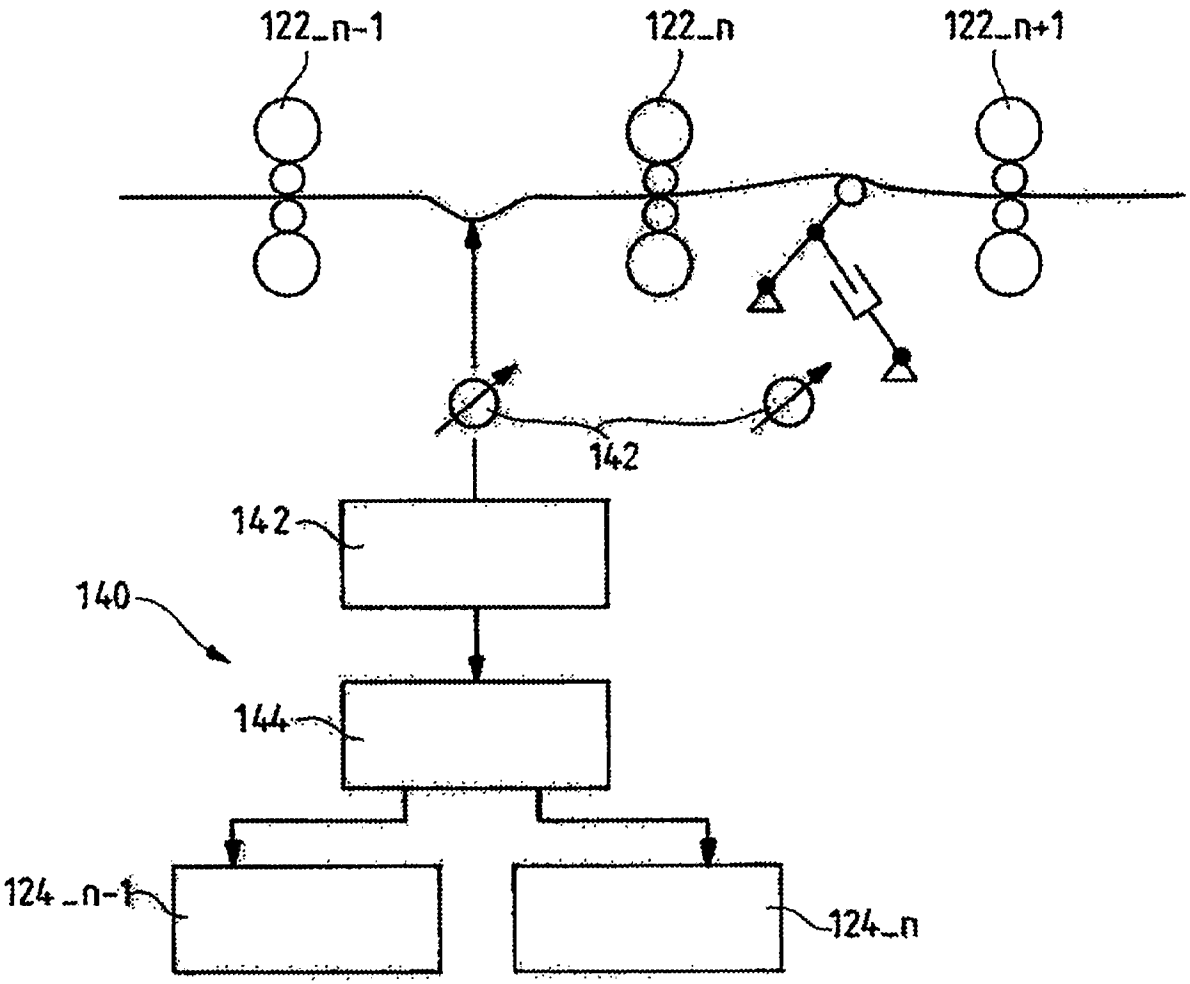

A total of six figures are attached to the invention, which indicate the following:

FIG. 1 a casting/rolling system according to prior art;

FIG. 2 a detailed view of the casting/rolling system according to prior art of FIG. 1;

FIG. 3 a schematic representation of the superordinate synchronization according to the invention of the drives of the strand casting machine and of the rolling line;

FIG. 4 a solidification model for calculating the position of the bottom tip with its inlet and outlet variables;

FIG. 5 the strand casting machine/drive model for calculating the torque distribution of the drive of the individual driven strand guide rollers within the strand guide with its inlet and outlet sizes, and FIG. 6 an example of mass flow regulation by means of a controlled loop formation of the strand material.

The invention will next be explained in more detail with reference to FIGS. 3 through 6 in the form of embodiments thereof.

FIG. 3 shows a schematic representation according to the invention of the control system of the drives and of the strand casting machine 110, as well as of the rolling line 120. The starting point of the concept according to the invention is a control circuit 130 for controlling the position of the bottom tip at a predetermined target position X_S_target within the strand guide 112. The target position X_S_target corresponds to a predetermined position of the path component x. The bottom tip regulation 130 ensures that the respective actual position of the bottom tip 160 is simulated or theoretically calculated by means of a solidification model 134, which creates the regulating distance of the bottom peak control loop 130. The position X_S_actual determined in this manner is compared to the predetermined target position X_S_target and a deviation, if it is eventually determined during the comparison, is supplied as a control variable to a controller 132 as an input variable. The controller then determines according to the value of the control deviation, as well as on the basis of a predetermined control strategy, a suitable value for certain control variables 133 that are suitable for influencing the position of the bottom tip. These control variables are in particular the intensity of the cooling of the strand material within the chill-mold and/or within the strand guide, i.e. inside the casting machine generally, the cross-sectional format, in particular the thickness h(x) of the strand material at certain locations inside and outside of the strand guide, the casting speed V_G and the geometry of the casting machine. Suitable values or modifications of the values that are determined by the controller are supplied to the solidification model as input variables 133. In the steady state of the casting/rolling system 100 and in particular of the strand casting machine 110, said control variables 133 will differ, if at all, only marginally. It is expected that the newly calculated actual position of the bottom peak 160 that is calculated from the solidification model on the basis of the supplied modified input variables is better adapted to the desired target position, see FIG. 4.

Two of these control variables, in particular the thickness H0 of the strand material 200 at the exit of the strand guide 112 and the value of the casting speed V_G are respectively introduced as input variables in the steady state of the strand casting machine 110 to pass sequence model 126 for the rolling line 120 as input variables. In addition, the thicknesses H1, H2 at the exit of the first and of the second roller frame are also supplied to the pass sequence model as input variables. The thicknesses H1 and H2 can be also determined independently from the pass sequence model. This can be advantageously obtained under the criteria for the target thickness HN and for the loading limit for the roller frames. The pass sequence model 126 then calculates according to the values of said input variables first a target rotational speed N1_target for the drive 124_1 of the first roller frame n1, and the target torques Mn_target for the drive 124_*n* of the remaining roller frames 112 n2 through 122_N, provided that they are present in the rolling line 120. The target rotational speed n1_target calculated in this manner for the drive 124_1 of the first roller frame 122_1 is then output to the driver controller 128 of the rolling line so that they will be again controlled accordingly. It is also possible to specify the target rotational speed for the first roller frame for the driver controller 128 while taking into account a correction value d_n.

The inclusion of the target torque Mn_target that is calculated from the pass sequence model 126 for the drives 124_*n* with $2<n\leq N$ is carried out essentially via the drive controller 128. This inclusion of the torques for the drives can be essentially realized for any thin strand materials, in particular for strand materials having a thickness of >0.6 mm. This first alternative is not shown in FIG. 3.

FIG. 3, on the other hand, shows a second alternative for the case when the thickness of the strand product downstream of the k-th roller frame 122_*k* with $k\geq 1$ is below a predetermined threshold value H_Lim. In this case it can be provided according to a second alternative, which is an alternative to the first alternative, that the drives 124_*n* with $k+1<n\leq N$ and with $k\leq 1$ for the roller framers 122_*n* with $k+1<n\leq N$ will not be impacted by the target torque predetermined by the pass sequence model in order to keep the mass flow constant also in the region of this roller frame so as to correspond to the mass flow predetermined by the first roller frame 122_1. Instead, the mass flow in the region of the following frames is maintained constant by providing looping control at least between these individual frames.

An example of a per se known mass flow control circuit 140 is shown in FIG. 6, wherein the mass flow between two frames is monitored or detected by means of a mass flow monitor 142, so that consequently, a mass flow controller 144 can generate a suitable control signal for the drive controller 128, or for the drive of the loop storage device of the upstream and/or downstream connected roller frame 122_*n*. As can be seen also from FIG. 3, said control parameters, which is to say the thickness H0 of the strand product 200 at the exit of the strand casting machine 110, as well as the casting speed V_G in the steady state, are not supplied only to the pass sequence model 126 for the rolling line, but also to the strand casting machine/drive model 115 as input variables. In addition, the distribution of the shell thickness f(x) calculated by the solidification model is also received as long as the strand material has not completely solidified yet, which is also calculated along the path component x from the solidification model along with thickness distribution h(h) of the strand 200 along the path component x, as well as from the predetermined total torque M_G, which corresponds to the sum of all target torques of the individual drives within the strand guide. Thanks to these input parameters, the strand casting machine drive model 115 calculates the suitable target torques Mi_target for the individual drives 114_*i* within the strand guide 112. These target values are output via the strand guide rollers/drive controller 117 to the drive 114_*i*; see also FIG. 5.

FIG. 5 shows said strand casting machine/drive model 115 with its input variables, which are evaluated by it in order to calculate a suitable distribution of predetermined target torques Mi_target for the individual drives 114_*i* within the strand guide 112 along the path component x. As can be seen from FIG. 5, the magnitude of the target torque is first increased in direction x starting from the exit from the chill-mold until a predetermined maximum value is reached at the height of the actual position of the bottom peak X_S_actual. This maximum value is then maintained for the torque of the drive within the strand guide until its metallurgic length L_G is reached.

LIST OF REFERENCE SYMBOLS

100 casting and rolling system
110 strand casting machine

111 chill-mold
112 strand guide
113_*i* i-th driven strand guide rollers
113*a* not-driven strand guide roller
114_*i* drive for i-th strand guide roller
115 strand casting machine drive model
117 strand guide roller drive control
118 slippage detection unit
120 rolling line
122_*n* n-th roller frame
124_*n* n-th driver for rollers of the n-th roller frame
126 pass sequence model
128 driver controller
129 inductive heating
130 bottom tip-regulation circuit
132 regulator
133 adjusting variables (=input variables of the solidification model)
134 regulation path=solidification model
140 mass flow monitor
144 mass flow regulator
160 bottom tip
170 cooling path
180 separating device
190 handling device
200 strand material
d_n correction value for the target rotational speed of the first roller frame
f(x) thickness of the shell of the strand material at the position x
g(x) temperature of the strand material at the position x
h(x) thickness of the strand material at the position x
H0 thickness of the strand material at the exit from the strand casting machine
H1 thickness of the strand material at the exit from the n=1 roller frame
H2 thickness of the strand material at the exit from the n=2 roller frame
Hk thickness of the strand material of the exit from the k-th roller frame
HN thickness of the warm band when it is leaving the rolling line
H_Lim predetermined threshold value for the strand material
i running parameter of the strand guide rollers or number of a roller frame
k parameter
L number of roughing frames in the rolling line
L_G metallurgic length of the strand casting machine
M_G total extraction torque
Mi_target target torque for the i-th strand guide target
Mn-target target torque for the n-th roller frame
n running parameter for roller frames or number of a roller frame
N maximum number of the roller frame or the last roller frame in the rolling line
nn_target target rotational speed for the n-th roller frame
n1_target target rotational speed for the first roller frame
V-G casting speed
x path coordinate in the casting direction—path coordinate in material flow direction
X_X_target target position of the bottom tip
X_S_target target position for the position of the bottom tip

The invention claimed is:

1. A method for operating a casting/rolling system for casting and rolling a continuous strand material, wherein the casting/rolling system comprises:

a strand casting machine and a rolling line arranged downstream of the strand casting machine, wherein the strand casting machine is provided with a chill-mold;

wherein the rolling line is provided with n roller frames, wherein n=1 through N, provided with respective drives for the roller frames, a pass sequence plan model and a drive controller for controlling the drives of the roller frames; and wherein the method comprises the following steps:

controlling the drive for rollers of a first roller frame, wherein n=1, by the drive controller in response to a target value specification of the pass sequence plan model;

wherein the strand casting machine is further provided with at least one strand guide arranged downstream of the chill-mold and upstream of the first roller frame with strand guide rollers and at least one drive for driving at least one of the strand guide rollers, a strand casting machine drive model and a strand guide roller drive controller, wherein control over the at least one drive of the at least one strand guide roller is performed via the strand guide roller drive controller in response to a target value specification of the strand casting machine drive model;

wherein the pass sequence plan model sets as a target value specification a target rotational speed for the drive of the first roller frame, n=1, of the rolling line, the drive of the first roller frame of the rolling line being the only drive of the strand casting machine or rolling line having a set target rotational speed, and wherein the pass sequence plan model only sets as a target value specification a target torque for drives of roller frames of the rolling line only where n=2 through N, being downstream of the first roller frame; and the strand casting machine drive model sets as a target specification a target torque that is set in advance for the drive of the at least one driven strand guide roller, wherein the at least one driven strand guide roller is not provided a target rotational speed, wherein the detection of rotational speeds is omitted for the strand guide rollers and the rollers of the roller frames, wherein a thickness of the strand material at an exit of the strand guide and a casting speed are input as variables in the pass sequence model for determining a target torque Mi for drives of the rolling line where n=2 through N and the thickness of the strand material at the exit of the strand guide and the casting speed are input as variables in the strand casting machine drive model for determining a target torque Mn for the drive of the at least one driven strand guide roller.

2. The method according to claim 1, wherein the pass sequence model presets a target torque for the drive of rollers n=2 through N.

3. The method according to claim 1, wherein the pass sequence model sets an individual target torque for the drives of the rollers of the roller frames n=2 through n=k with k<N, each time a thickness of the strand material is below a predetermined thickness threshold value at an outlet of a roller frame n=k; and wherein a mass flow—seen in a direction of a material flow—is maintained constant after the k-th roller frame by means of a controlled or regulated loop formation of the strand material.

4. The method according to claim 3, wherein a predetermined target position is monitored in order to control the loop formation of each current position of the strand material.

5. The method according to claim 3, wherein the predetermined thickness threshold value at the outlet of the k-th roller frame is preset in dependence on an elasticity/E modulus of the strand material.

6. The method according to claim 1, wherein slippage of at least individual strand guide rollers is monitored and countered as required when there is a risk of a through-slippage of the strand guide roller at which the slippage was detected.

7. The method according to claim 1, wherein a position of a bottom tip of the strand material within the strand guide is controlled with suitable variations of control variables of a solidification model at a predetermined target position.

8. The method according to claim 7, wherein the control variables are in particular a cooling intensity of the strand material in the casting machine, a format of a cross-section, in particular thickness of the strand material in certain locations within and at an exit of the strand guide, a casting speed and a geometry of the casting machine.

9. The method according to claim 8, wherein the target rotational speed for the drive of the processing rollers of the first roller frame n=1 and the target torques for the drive of the processing rollers of the roller frames n=2 through n=N are set according to a specification of values for the thickness of the strand material at the exit of the strand casting machine and of the value for the casting speed, each time in the steady state of the casting/rolling system, and according to a specification of the measured thicknesses of the strand material at the exit of the first and of the second roller frame of the rolling line, calculated and preset by the pass sequence model.

10. The method according to claim 9, wherein the target torque for the drive of at least one driven strand guide roller is set according to a specification of the value for the thickness of the strand material at an exit of the strand guide and of a value for the casting speed, each time in the steady state of the casting roller system, as well as according to specification of a value for a strand extraction torque and profiles of a shell thickness and a temperature within and at the exit of the strand guide, calculated and preset by the strand casting machine drive model.

11. The method according to claim 1, wherein the target torques for the drives of the strand guide rollers are preset suitably distributed over a length of the strand guide by the strand casting machine drive model, while taking into account a strand casting machine geometry, a strand extraction total torque, as well as a distribution of the thickness of the strand shell and the temperature over the length of the strand guide.

12. The method according to the claim 11, wherein the target torques of the strand casting machine drive model are present in such a manner that they are increasing in a first region from a chill-mold exit until an actual position of the bottom tip of the strand material within the strand guide, and remain constant in a second region of the bottom tip until a metallurgic length of the strand casting machine.

13. The method according to claim 1, wherein a change of the value for a target rotational speed of the first roller frame and of a target value for the torques of the drives of the strand guide rollers and of the drives of the rollers of the roller frames occurs over temporal ramps.

* * * * *